US007003129B2

(12) United States Patent
Hecht

(10) Patent No.: US 7,003,129 B2
(45) Date of Patent: Feb. 21, 2006

(54) WALL MOUNTED SPEAKER ENCLOSURE

(75) Inventor: Kenneth B. Hecht, Jacksonville, FL (US)

(73) Assignee: United Speaker Systems, Inc., Jacksonville, FL (US)

( * ) Notice: Subject to any disclaimer, the term of this patent is extended or adjusted under 35 U.S.C. 154(b) by 208 days.

(21) Appl. No.: 10/750,731

(22) Filed: Jan. 2, 2004

(65) Prior Publication Data

US 2005/0147270 A1 Jul. 7, 2005

(51) Int. Cl.
*H04R 25/00* (2006.01)

(52) U.S. Cl. ..... 381/395; 381/386; 181/150

(58) Field of Classification Search ..... 381/87, 381/150, 152, 189, 332, 345, 386, 388, 391, 381/395; 181/141, 148, 150, 155, 156, 199; 40/700; 411/340, 341, 434, 345, 347, 349; 362/147, 148, 364, 365, 366, 368
See application file for complete search history.

(56) References Cited

U.S. PATENT DOCUMENTS 6,487,299 B1 * 11/2002 Peng ..... 381/395
6,588,543 B1 * 7/2003 Tchilinguirian ..... 181/150
2005/0045415 A1 * 3/2005 Popken et al. ..... 181/150

* cited by examiner

*Primary Examiner*—Sinh Tran
*Assistant Examiner*—Brian Ensey
(74) *Attorney, Agent, or Firm*—Arthur G. Yeager

(57) ABSTRACT

A wall mounted speaker includes a baffle and a flange and fasteners for affixing the baffle to the flange. The fasteners include a plurality of spaced posts and latch members. Each latch engages a corresponding post. The lower portion of each post is affixed to the flange and the corresponding latch is removably and pivotally mounted to the upper portion of a post. Each latch includes a body portion, a lever and a cam and is movable between a first position where the body portion is engaged with the baffle and the cam is mounted to upper portion of a post for securing the baffle to the flange and a second position wherein the body portion is moved away from the baffle for releasing the baffle from the flange. The baffle includes a plurality of channels adjacent a respective post. The body portion of each latch is positioned in a respective channel when the latch member is in the first position. The cam includes a slot formed therein for mounting the latch around an upper portion of a post.

20 Claims, 5 Drawing Sheets

WALL MOUNTED SPEAKER ENCLOSURE

CROSS REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to apparatus for mounting a speaker into a wall or a ceiling and particularly apparatus for attaching a speaker baffle to a wall mounted flange.

2. Relevant Art

Currently there are two main approaches to installing a custom installation (CI) speaker into a wall. The first is a single piece flange/speaker baffle assembly. This type is secured to the wall by inserting it through a cut out in the wall and using screws and rotating feet clamp the wall (some use a ring to clamp the wall) between the baffle and the feet. The second is to insert a separate flange into the wall and then come back later and attach the speaker baffle to the flange by some means. There are a few different methods of doing this. One is to screw it to the flange. Another is to use some sort of quick attachment method such as a quarter or half turn screw or a clip in arrangement. In the round type there are also companies using a bayonet mount. What is desired is a quicker, easier and secure mount for attaching the baffle to the flange.

BRIEF SUMMARY OF THE INVENTION

In one aspect of the present invention there is provided a wall mounted speaker enclosure comprising a baffle and a flange and fastening means for affixing the baffle to the flange, the fastening means including a plurality of spaced post members and cooperating latch members, each latch member engaging a corresponding post member. Each latch member is engaged with one post member. Each latch member includes a body portion with a lever and a cam member and is movable between a first position where the body portion is engaged with the baffle and the latch member is engaged with the post member to securing the baffle to the flange and a second position wherein the lever of the body portion is moved away from the baffle and the latch disengages the post member for releasing the baffle from the flange. The baffle includes a plurality of channels each having spaced side walls and a bottom wall formed therein, each channel being adjacent a respective post member and the body portion of each latch member being positioned in a respective channel and against the bottom wall thereof when the latch member is in the first position. The flange includes a plurality of spaced holes, each post member being mounted in a respective hole.

The cam member of each latch member includes a slot formed therein for mounting the latch member around the respective post member. The slot is sized to have a length extending from an outside portion of the cam member to substantially medially of the cam member and a width substantially a diameter of a respective post member for pivotally mounting the latch member to the post member. The cam member also includes an arcuate lower body portion, the lower body portion frictionally engaged with the baffle when said latch member is in the first position for inhibiting the movement of the latch member from the first position.

In another aspect of the present there is provided a wall mounted speaker comprising a baffle and a flange and fastening means for affixing the baffle to the flange, the fastening means including a plurality of spaced post members and latch members, each latch member engaging a corresponding post member. Each post member having an upper and lower portion and the lower portion of each post member is affixed to the flange. Each latch member is removably and pivotally mounted to the upper portion of the corresponding post member. Each latch member includes a body portion and a cam member and is movable between a first position wherein the body portion is engaged with the baffle and the cam member being mounted to the upper portion of the post member for securing the baffle to the flange and a second position wherein the body portion is moved away from the baffle for releasing the baffle from the flange. The baffle includes a plurality of channels, each having side walls and a bottom wall formed therein, each channel being adjacent the upper portion of a respective post member, the body portion of each latch member being positioned in a respective channel and against the bottom wall thereof when the latch member is in the first position. The flange includes a plurality of spaced holes, the lower portion of each post member being mounted in a respective hole. The cam member of each latch member includes a slot formed therein for mounting a latch member around the upper portion of a respective post member by positioning the upper portion of the respective post member in the slot. The cam member of each latch member includes a slot sized to have a length extending from an outside portion of the cam member to substantially medially of the cam member and a width substantially a diameter of a respective upper portion of the post member for pivotally mounting the latch member to the upper portion of the post member. The cam member includes an arcuate lower body portion frictionally engaged with the baffle when the latch member is in the first position for inhibiting the movement of the latch member from the first position.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description, taken in connection with the accompanying drawings, in which:

DETAILED DESCRIPTION OF THE INVENTION

Figure 1:
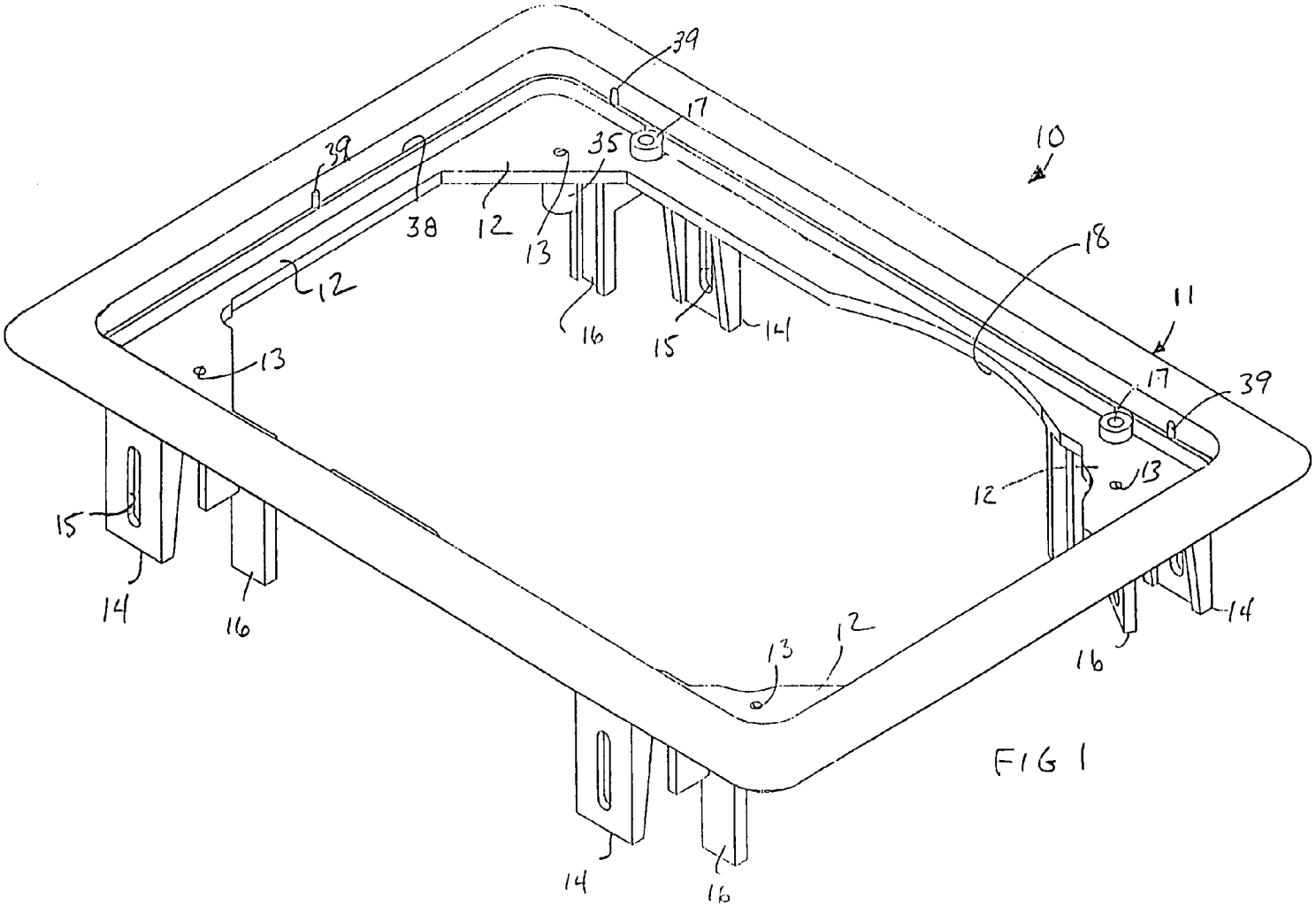
FIG. 1 is a perspective view of the flange in accord with the present invention.

With respect to FIG. 1, a flange in accord with the present invention is shown generally at numeral 10. Flange 10 includes a body 11 having an interior perimeter flange portion 12 defining an interior space 18 with four spaced baffle fastener holes 13 formed at the corners thereof. A first type of subtending flanges 14 has elongated slots 15 formed therein for use with fastener means, for example, clamps (not shown) for securing the flange 10 inside a cut in a wall. A second type of subtending flanges 16 is used as a stop to limit rotary movement of clamps mounting the flange 10 to a wall to position the flange 10 in a cutout in a wall or a ceiling. Flange securing hollow bosses 17 are formed on flange 12 and receive respective screws (not shown) that connect to feet (not shown) to mount or clamp to a wall.

Figure 2:
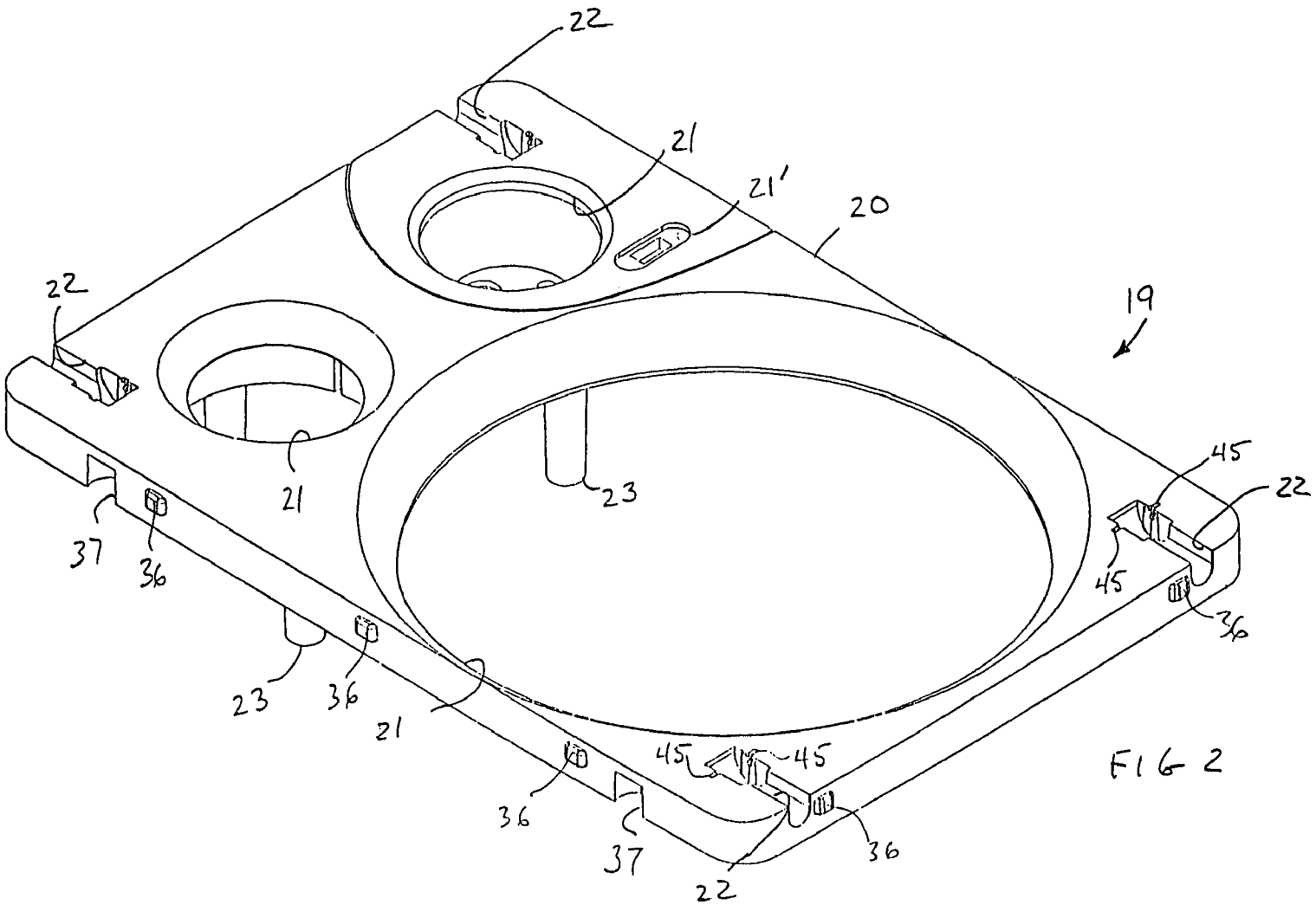
FIG. 2 is a perspective view of the baffle in accord with the present invention.

With respect to FIG. 2, a baffle 19 includes body 20 with a plurality of spaced speaker openings 21 and switch recess 21' as appropriate in the circumstances and a plurality of spaced flip latch channels 22. Subtending flanges 23 are used for mounting the crossovers networks.

Figure 3:
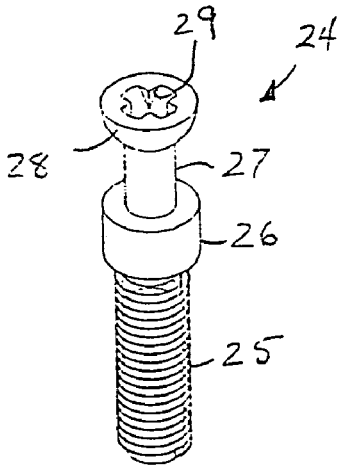
FIG. 3 is a perspective view of one type of fastener used in the present invention.
Figure 4:
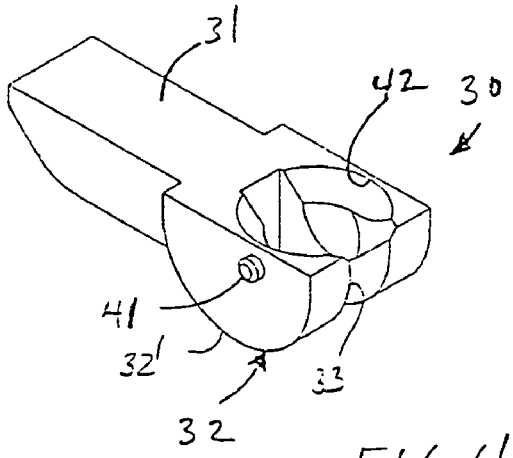
FIG. 4 is a perspective view of a flip latch in accord with the present invention.

FIG. 3 illustrates fastener 24 in the form of an elongated post that includes threaded shank 25, circular flange 26, upper unthreaded shank 27, head 28, and screwdriver slot 29. Alternately, a fastener may be molded as part of the flange 10 or secured to flange 10 by other means. Flip latch 30 is shown in FIG. 4 and includes lever body 31 and a cam member 32 formed with a slot 33 therein sized to fit around the upper unthreaded shank 27 of the fastener 24.

Figure 5:
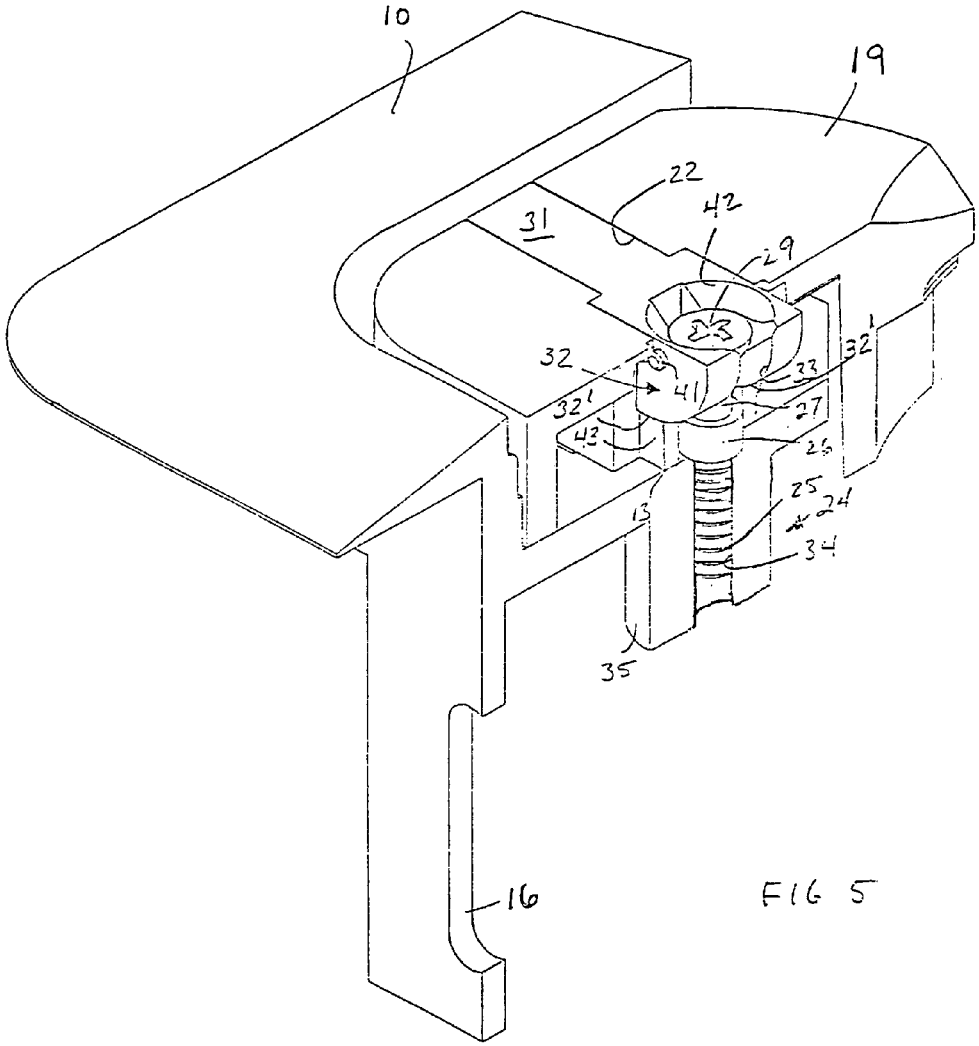
FIG. 5 is a perspective view of a partial cutaway portion of the present invention employing a second type of fastener in accord with the present invention.

In FIG. 5 the structure and operation of the flip latch 30 and fastener 24 is illustrated in a cutaway diagram. Downwardly subtending post 35 is part of flange 10 and includes a threaded passageway 34 formed by the self-tapping of fastener 24.

The baffle 19 includes a pair of spaced oppositely disposed axle slots 45 in walls forming channels 22 (see also FIG. 2) and cam 32 has a pair of spaced oppositely disposed stub axles 41 projecting therefrom which respectively fit into slots 45, so that latches 30 may be pivoted about such axles 41.

Figure 6:
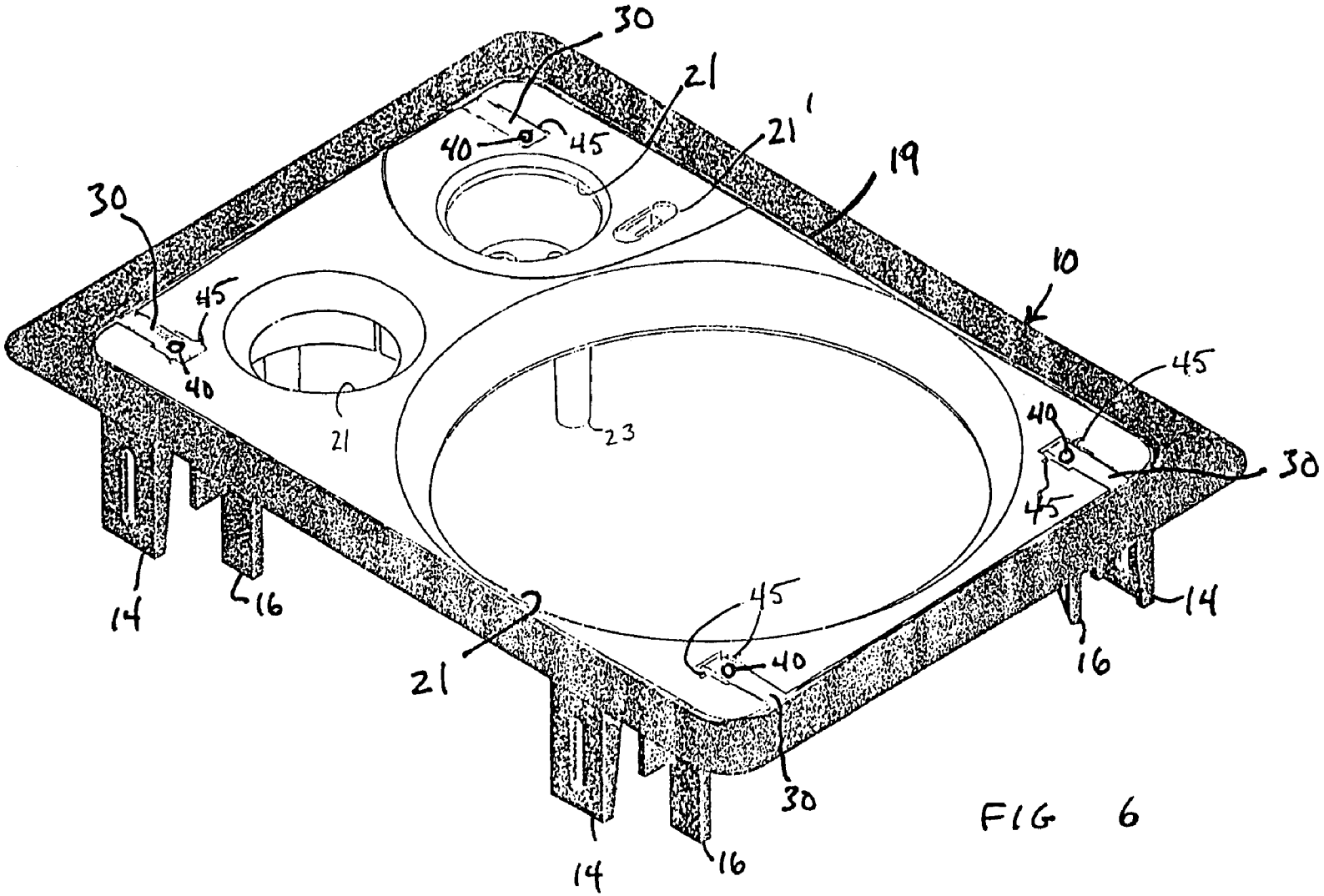
FIG. 6 is a perspective view of the present invention in assembled form.

FIG. 6 illustrates a baffle 19 installed in flange 10 utilizing the flip latches 30 in accord with the present invention. Flip latch 30 is installed by sliding slot 33 of cam 32 around the unthreaded shank 27 of the respective fastener 24 being utilized. The lever body 31 is then pushed downwardly into channel 22 against baffle 19, exerting an upward force on fastener 24 affixed to flange 10 and causing the lower portion 32' of cam 32 to bind against the upper portion of projecting wall portion 43 to lock latch 30 into position thereby securing baffle 19 to flange 10. Pulling up on the lever body 31 disengages cam 31 from head 28 of fastener 24 thereby removing the force on the upper portion of fastener 24 and also removing the binding action between cam 32 and the baffle 19 thereby releasing the baffle 19 from the flange 10.

The baffle 19 is precision molded with a plurality of perimeter bosses 36 and slots 37. The flange 10 is also precision molded with an interior perimeter ridge 38 and bosses 39. Slots 37 fit around bosses 17. Bosses 36 and bosses 39 are employed to engage a grill (not shown) which frictionally maintain the grill in place so that baffle 10 is aligned with and fits flush inside the flange 10. Threaded fasteners 24 have been self tapered into holes 13/34 of bosses 35 prior to activation of flip latches 30 that engage the respective fasteners 24. The entire assembled enclosure is provided as a unit to an installer.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed is:

1. A wall mounted speaker enclosure comprising a baffle and a flange and fastening means for affixing said baffle to said flange, said fastening means including a plurality of spaced post members and cooperating latch members, each said latch member engaging a corresponding said post member, each said latch member including a body portion with a lever and a cam member and being movable between a first position wherein said body portion is engaged with said baffle and said latch member is engaged with said post member to secure said baffle to said flange and a second position wherein said lever of said body portion is moved away from said baffle and said latch member disengages said post member for releasing said baffle from said flange.

2. The speaker as defined in claim 1 wherein said baffle includes a plurality of channels each having spaced side walls and a bottom wall formed therein, each channel being adjacent a respective said post member, said body portion of each said latch member being positioned in a respective said channel and against said bottom wall thereof when said latch member is in said first position.

3. The speaker as defined in claim 1 wherein said flange includes a plurality of spaced holes, each said post member being mounted in a respective said hole.

4. The speaker as defined in claim 1 wherein said cam member of each latch member includes a slot formed therein for mounting said latch member around respective said post member.

5. The speaker as defined in claim 1 wherein said cam member of each said latch member includes a slot sized to have a length extending from an outside portion of said cam member to substantially medially of said cam member and a width substantially equal to a diameter of a respective said post member for pivotally mounting said latch member to said post member.

6. The speaker as defined in claim 5 wherein said cam member includes an arcuate lower body portion, said lower body portion frictionally engaged with said baffle when said latch member is in said first position for inhibiting the movement of said latch member from said first position.

7. The speaker as defined in claim 1 wherein said cam member includes an arcuate lower body portion, said lower body portion frictionally engaged with said baffle when said latch member is in said first position for inhibiting the movement of said latch member from said first position.

8. A wall mounted speaker comprising a baffle and a flange and fastening means for affixing said baffle to said flange, said fastening means including a plurality of spaced post members and cooperating latch members, each said latch member engaging a corresponding said post member, each said post member having an upper and lower portion, said lower portion of each said post member being affixed to said flange, each said latch member being removably and pivotally mounted to said upper portion of said corresponding post member, each said latch member including a body portion with a lever and a cam member and movable between a first position wherein said body portion is engaged with said baffle and said cam member is engaged with said upper portion of said post member for securing said baffle to said flange and a second position wherein said body portion is moved away from said baffle for disengaging said cam member from said upper portion of said post member, releasing said baffle from said flange.

9. The speaker as defined in claim 8 wherein said baffle includes a plurality of channels, each having side walls and a bottom wall formed therein, each channel being adjacent said upper portion of a respective said post member, said body portion of each said latch member being positioned in a respective said channel and against said bottom wall thereof when said latch member is in said first position.

10. The speaker as defined in claim 8 wherein said flange includes a plurality of spaced holes, said lower portion of each said post member being mounted in a respective said hole.

11. The speaker as defined in claim 8 wherein said cam member of each latch member includes a slot formed therein for mounting said latch member around said upper portion of a respective said post member by positioning said upper portion of said respective post member in said slot.

12. The speaker as defined in claim 8 wherein said cam member of each said latch member includes a slot sized to have a length extending from an outside portion of said cam member to substantially medially of said cam member and a width substantially equal to a diameter of a respective said upper portion of said post member for pivotally mounting said latch member to said upper portion of said post member.

13. The speaker as defined in claim 12 wherein said cam member includes an arcuate lower body portion, said lower body portion frictionally engaged with said baffle when said latch member is in said first position for inhibiting the movement of said latch member from said first position.

14. The speaker as defined in claim 8 wherein said cam member includes an arcuate lower body portion, said lower body portion frictionally engaged with said baffle when said latch member is in said first position for inhibiting the movement of said latch member from said first position.

15. A wall mounted speaker enclosure comprising a baffle and a flange and fastening means for affixing said baffle to said flange, said fastening means including a plurality of spaced post members mounted to said flange and latch members, each said latch member engaging a corresponding said post member, each said latch member with a lever engaging to one said post member, each said latch member including a body portion with a lever and a cam member and movable between a first position wherein said body portion is engaged with said baffle and said cam member is engaged with said post member and said baffle for securing said baffle to said flange and a second position wherein said lever of said body portion is moved away from said baffle for releasing said baffle from said flange, said baffle including a plurality of channels each having spaced side walls and a bottom wall formed therein, each channel being adjacent a respective said post member, said body portion of each said latch member being positioned in a respective said channel and against said bottom wall thereof when said latch member is in said first position.

16. The speaker as defined in claim 15 wherein said flange includes a plurality of spaced holes, each said post member being mounted in a respective said hole.

17. The speaker as defined in claim 15 wherein said cam member of each latch member includes a slot formed therein for mounting said latch member around respective said post member.

18. The speaker as defined in claim 15 wherein said cam member of each said latch member includes an arcuate lower body portion and a slot sized to have a length extending from an outside portion of said cam member to substantially medially of said cam member and a width substantially equal to a diameter of a respective said post member for pivotally mounting said latch member to said post member.

19. The speaker as defined in claim 15 wherein said cam member includes an arcuate lower body portion, said lower body portion frictionally engaged with said baffle when said latch member is in said first position for inhibiting the movement of said latch member from said first position.

20. The speaker as defined in claim 15 wherein said flange includes a plurality of spaced holes, each said post member being mounted in a respective said hole, said cam member of each said latch member including an arcuate lower body portion and a slot sized to have a length extending from an outside portion of said cam member to substantially medially of said cam member and a width substantially equal to a diameter of a respective said post member for pivotally mounting said latch member to said post member.

* * * * *